US008322054B2

(12) United States Patent
Feller et al.

(10) Patent No.: US 8,322,054 B2
(45) Date of Patent: Dec. 4, 2012

(54) SHOE WITH INTERCHANGEABLE STRAP SYSTEM

(76) Inventors: Craig Feller, Evergreen, CO (US); David G. Berg, White Lake, MI (US); Thomas E. McGann, III, Walled Lake, MI (US)

( * ) Notice: Subject to any disclaimer, the term of this patent is extended or adjusted under 35 U.S.C. 154(b) by 608 days.

(21) Appl. No.: 12/498,452

(22) Filed: Jul. 7, 2009

(65) Prior Publication Data

US 2010/0000127 A1 Jan. 7, 2010

Related U.S. Application Data

(60) Provisional application No. 61/078,647, filed on Jul. 7, 2008.

(51) Int. Cl.
*A43B 3/24* (2006.01)
*A43B 3/12* (2006.01)

(52) U.S. Cl. ..... 36/101; 36/11.5

(58) Field of Classification Search ..... 36/101, 36/11.5; D2/917, 916
See application file for complete search history.

(56) References Cited

U.S. PATENT DOCUMENTS

| | | | | |
|---|---|---|---|---|
| 1,823,445 | A | | 9/1931 | Goldstone |
| 2,253,860 | A | | 8/1941 | Martin |
| D132,630 | S | | 6/1942 | Pfieffer |
| D136,742 | S | | 11/1943 | Keyes |
| 2,393,701 | A | | 3/1944 | Pickens |
| 2,491,297 | A | | 12/1949 | Brown |
| 2,495,984 | A | | 1/1950 | Roy |
| 2,526,940 | A | | 10/1950 | Fella |
| D161,707 | S | | 1/1951 | Peterson |
| 2,590,648 | A | | 3/1952 | Pitz |
| 2,607,133 | A | | 8/1952 | Marlowe |
| 2,694,438 | A | | 11/1954 | Wilhelm |
| 2,873,540 | A | | 2/1959 | Murphy |
| 2,889,639 | A | | 6/1959 | Rudine |
| 2,957,253 | A | | 10/1960 | Metzler |
| 3,063,166 | A | | 11/1962 | Blavier |
| 3,228,124 | A | | 1/1966 | Schwartz |
| 3,455,037 | A | | 7/1969 | Vlas et al. |
| 3,672,078 | A | | 6/1972 | Fukuoka et al. |
| 3,739,501 | A | | 6/1973 | Barrett, Jr. |
| 3,867,771 | A | | 2/1975 | Levine |
| D238,625 | S | * | 2/1976 | York, Jr. ..... D2/917 |
| 3,983,642 | A | | 10/1976 | Liao |
| D247,073 | S | | 1/1978 | Kane et al. |
| 4,069,601 | A | | 1/1978 | Robbins et al. |
| 4,114,295 | A | | 9/1978 | Schaefer et al. |
| 4,114,296 | A | | 9/1978 | Smith |
| 4,172,330 | A | | 10/1979 | Kao |
| 4,193,214 | A | | 3/1980 | Wang et al. |
| 4,267,649 | A | | 5/1981 | Smith |

(Continued)

FOREIGN PATENT DOCUMENTS

DE 202008009070 U1 9/2008

(Continued)

*Primary Examiner* — Ted Kavanaugh
(74) *Attorney, Agent, or Firm* — Gifford, Krass, Sprinkle, Anderson & Citkowski, P.C.; Douglas L. Wathen

(57) ABSTRACT

A shoe has a sole member with an upper surface for receiving a user's foot and a lower surface for contacting a support surface. An interchangeable strap has a sole member engaging portion and may be selectively interconnected with the sole member.

30 Claims, 11 Drawing Sheets

U.S. PATENT DOCUMENTS 4,279,083 A 7/1981 Dilg
4,297,798 A 11/1981 Colan
4,300,294 A 11/1981 Riecken
4,314,412 A 2/1982 Anderson et al.
4,343,057 A 8/1982 Bensley
4,348,820 A 9/1982 D'Alessio
4,363,177 A 12/1982 Boros
4,370,818 A 2/1983 Simoglou
4,439,935 A 4/1984 Kelly
4,450,633 A 5/1984 Connelly et al.
4,461,102 A 7/1984 DeVincentis
4,497,123 A 2/1985 Ehrlich et al.
4,563,787 A 1/1986 Drew et al.
4,745,693 A 5/1988 Brown
4,843,736 A 7/1989 Courian
4,854,056 A 8/1989 Levin
4,869,000 A 9/1989 York, Jr.
4,887,369 A 12/1989 Bailey et al.
4,896,440 A 1/1990 Salaverria
4,967,750 A 11/1990 Cherniak et al.
5,052,131 A 10/1991 Rondini
5,065,531 A 11/1991 Prestridge
D332,515 S 1/1993 Middleton
D333,904 S 3/1993 Eminger
5,381,610 A 1/1995 Hanson
5,410,821 A 5/1995 Hilgendorf
5,423,134 A 6/1995 Bagnaia et al.
5,459,948 A 10/1995 Aveni
5,477,625 A 12/1995 Goldsmith et al.
D365,923 S 1/1996 Crowley
5,483,757 A 1/1996 Frykberg
D374,335 S 10/1996 Grimes
5,611,156 A 3/1997 Chiu
D385,999 S 11/1997 Tong
5,692,322 A 12/1997 Lombardino
5,778,565 A 7/1998 Holt et al.
5,802,738 A 9/1998 Ferniani
5,836,090 A 11/1998 Smith
5,848,484 A 12/1998 Dupree et al.
5,852,885 A 12/1998 Ferniani et al.
D403,493 S 1/1999 McKinley
5,896,684 A 4/1999 Lin et al.
5,946,823 A 9/1999 Yates
D421,828 S 3/2000 Malka
6,035,554 A 3/2000 Duncan
6,128,834 A 10/2000 Vecchiola et al.
D441,942 S 5/2001 Kelchak
6,282,818 B1 9/2001 Lu et al.
D448,542 S 10/2001 Bryant
D450,178 S 11/2001 Boncutter
D454,425 S 3/2002 Boncutter
D467,407 S 12/2002 Berg et al.
D467,709 S 12/2002 Berg et al.
D470,304 S 2/2003 Berg et al.
D471,346 S 3/2003 Bray, Jr. et al.
D485,050 S 1/2004 Lin
D485,970 S 2/2004 Magro et al.
D485,971 S 2/2004 Magro et al.
D492,474 S 7/2004 Branstrom
D492,841 S 7/2004 Magro
D493,954 S 8/2004 Magro
D495,123 S 8/2004 Wakatake
D495,124 S 8/2004 Wakatake
6,792,696 B2 9/2004 Berg et al.
D497,243 S 10/2004 McClaskie
D499,236 S 12/2004 Magro et al.
D511,241 S 11/2005 Cobian
D514,778 S 2/2006 Berg et al.
D514,780 S 2/2006 Berg et al.
D518,947 S 4/2006 Choi et al.
7,028,420 B2 4/2006 Tonkel
D521,214 S 5/2006 Choi et al.
D528,747 S 9/2006 Issler
7,117,615 B2 10/2006 Gerber
D535,085 S 1/2007 Berg et al.
D535,464 S 1/2007 Belley et al.
7,162,814 B2 1/2007 Berg et al.
7,174,657 B2 2/2007 Berg et al.
D542,514 S 5/2007 Amado et al.
D543,345 S 5/2007 Andersen et al.
D545,034 S 6/2007 Amado et al.
D552,343 S 10/2007 Brandenburg
D554,330 S 11/2007 White
D558,435 S 1/2008 Masoodifar
D558,958 S 1/2008 Motomura et al.
7,328,527 B2 2/2008 Goldman
D564,734 S 3/2008 Krompasick et al.
D575,051 S 8/2008 Barteet
D575,943 S 9/2008 del Biondi et al.
D577,479 S 9/2008 Weitzman
D577,882 S 10/2008 Little
2002/0078600 A1 6/2002 Berg et al.
2002/0100189 A1 8/2002 Manzi
2006/0053663 A1 3/2006 Mao
2007/0186443 A1 8/2007 Berg et al.
2007/0261266 A1 11/2007 Jones et al.
2008/0168682 A1* 7/2008 Le ..... 36/101
2009/0038181 A1* 2/2009 Loughnane ..... 36/94

FOREIGN PATENT DOCUMENTS

GB 2071481 A 9/1961
GB 2167592 A 5/1986

* cited by examiner

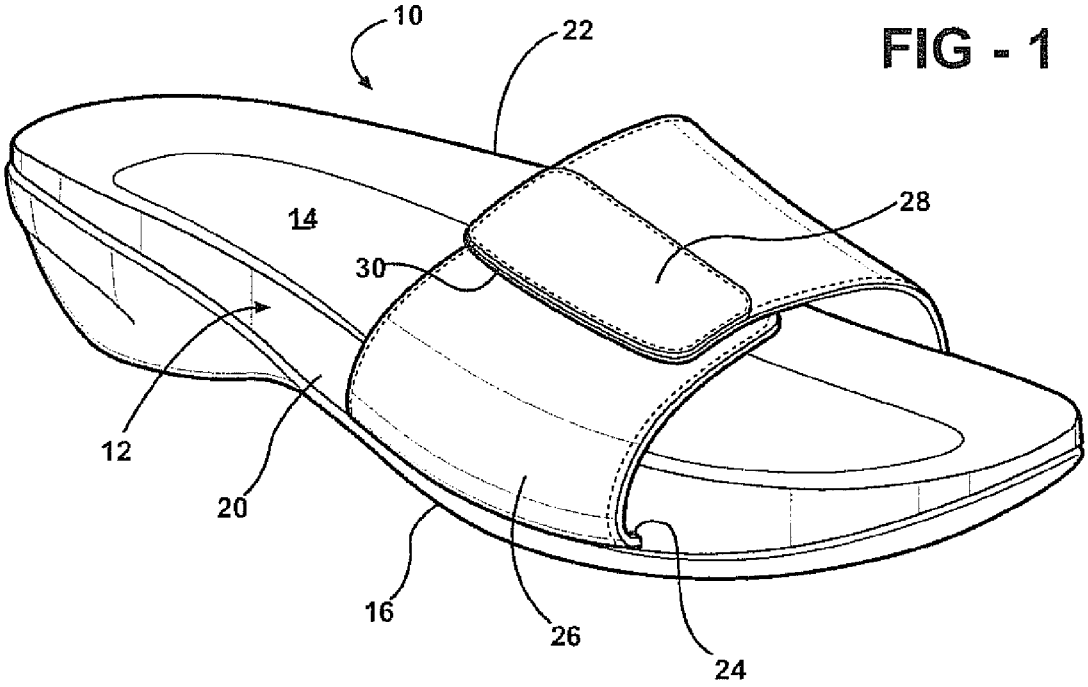
FIG - 1
FIG - 3
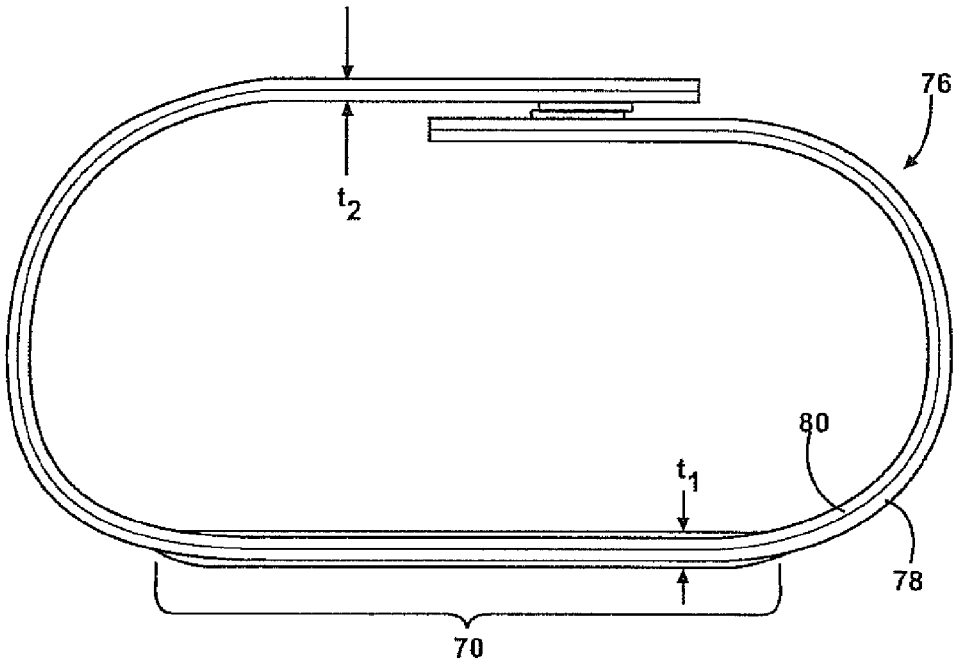

FIG - 5
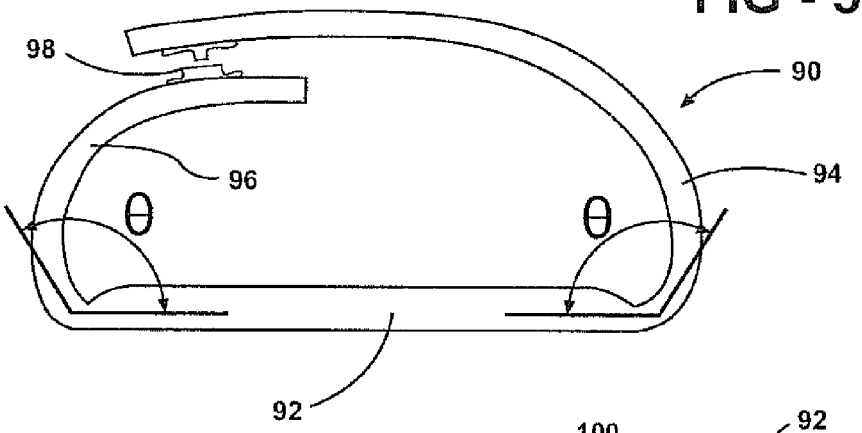
FIG - 6
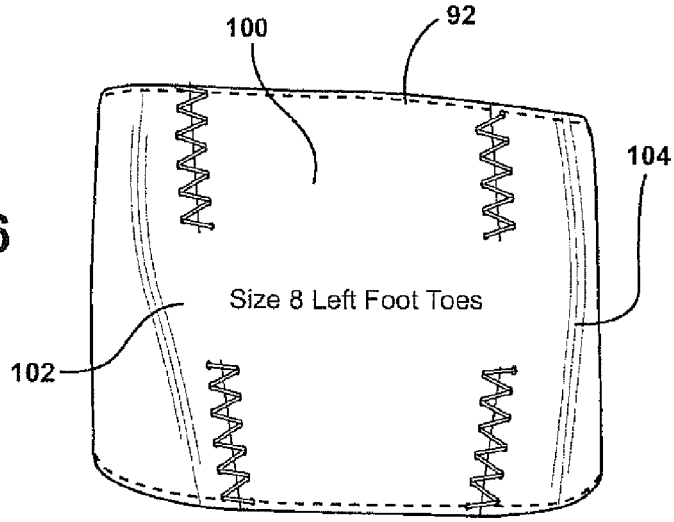
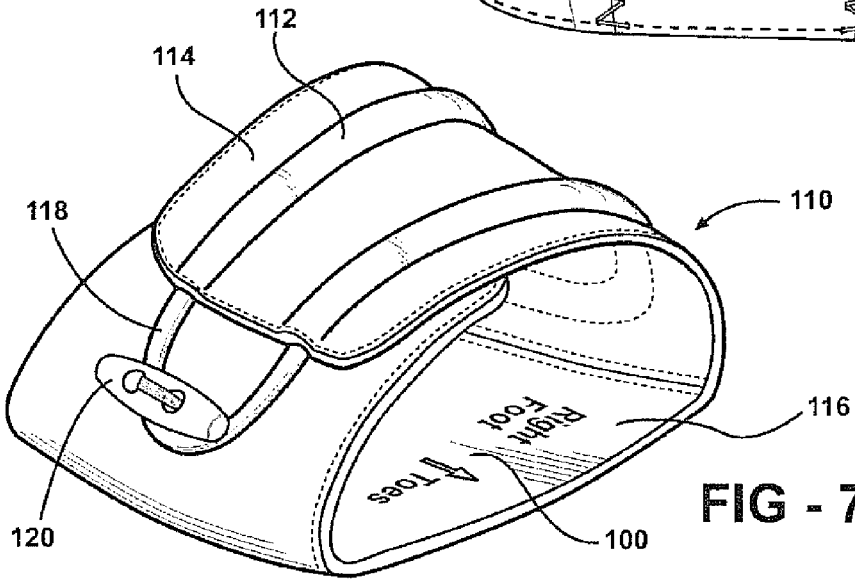
FIG - 7

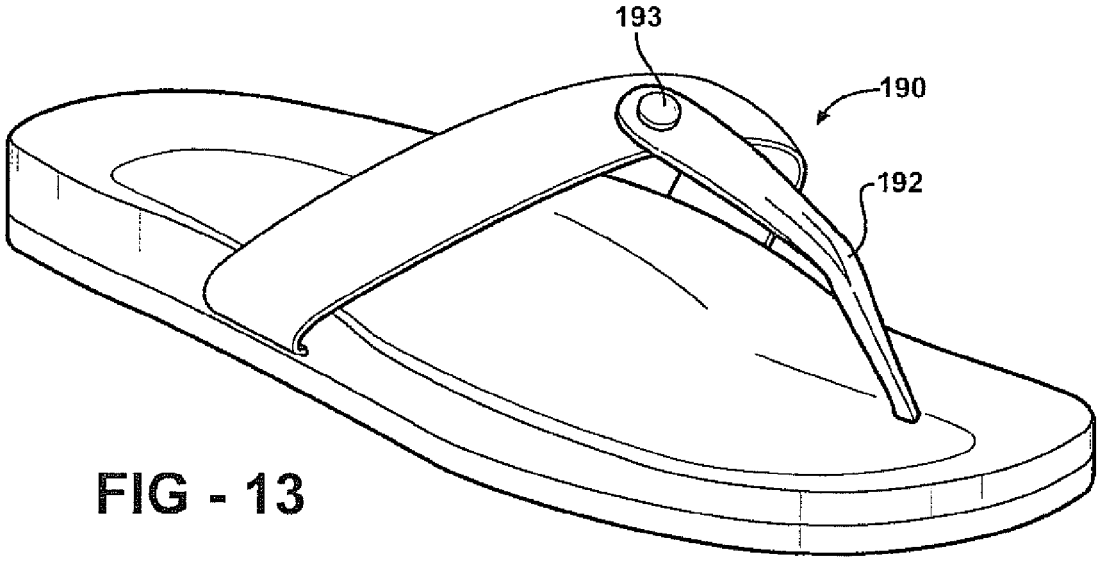
FIG - 13
FIG - 14
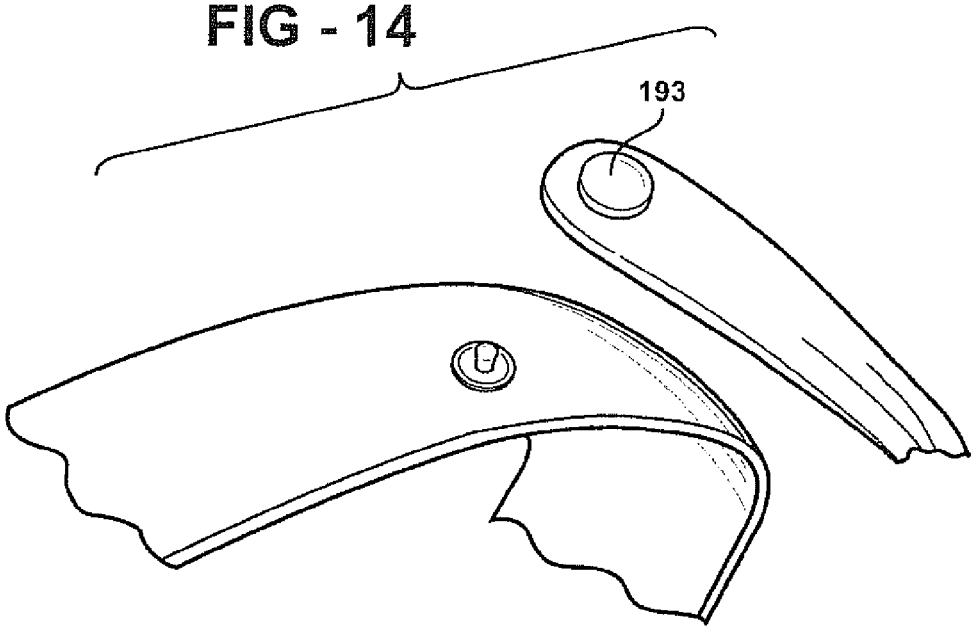

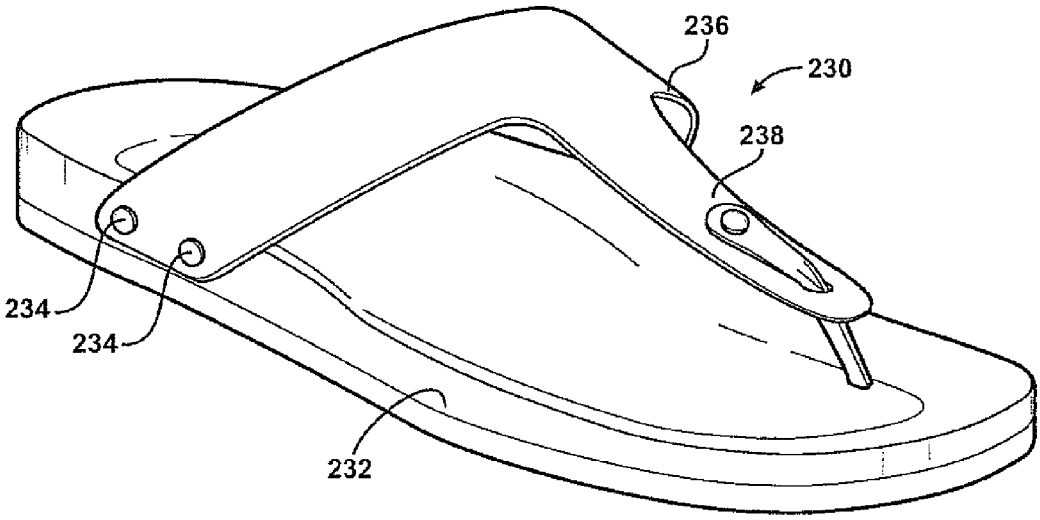
FIG - 19
FIG - 20
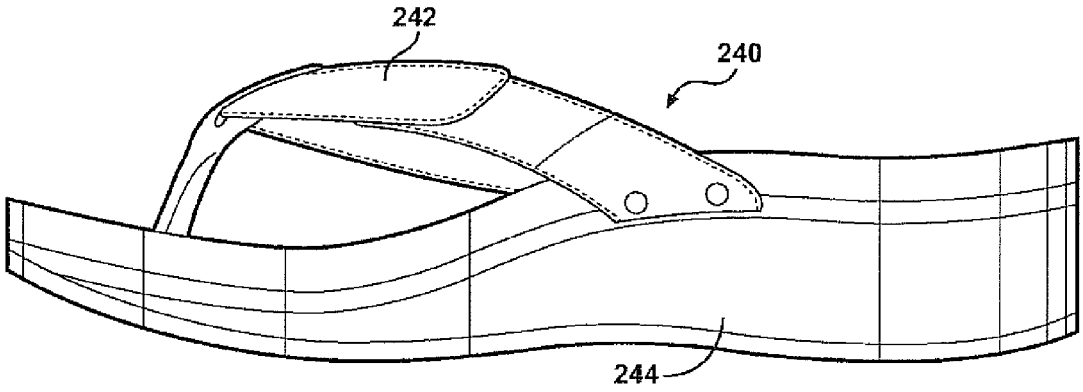

SHOE WITH INTERCHANGEABLE STRAP SYSTEM

CROSS REFERENCE TO RELATED APPLICATIONS

This application claims priority to U.S. provisional patent application Ser. No. 61/078,647, filed Jul. 7, 2008; U.S. design patent application Ser. No. 29/330,488, filed Jan. 8, 2009; U.S. design patent application Ser. No. 29/330,493, filed Jan. 8, 2009; and to U.S. design patent application Ser. No. 29/330,495, filed Jan. 8, 2009, all of which are incorporated in their entirety by reference herein.

FIELD OF THE INVENTION

The present invention relates generally to footwear and, more specifically, to a shoe with an interchangeable strap to allow aesthetic and functional changes to the shoe.

BACKGROUND OF THE INVENTION

Footwear comes in an enormous variety of styles and designs to suit numerous functional and aesthetic goals. Fashion conscious consumers often wish to coordinate their footwear with the remainder of their attire. For example, some consumers may wish to own several pairs of very similar shoes in a variety of colors so as to color-coordinate with a variety of outfits. However, this may require the purchase of a large number of pairs of shoes, sandals, boots, and other footwear. This presents both a financial burden and difficulty in storing the footwear. In tight of this, there is a need for footwear that allows easy coordination with a variety of clothing.

There have been a number of attempts to provide footwear that has changeable portions to allow alterations in the appearance and/or function of the footwear. U.S. Pat. No. 2,495,984 to Roy provides a flat sole with laces that may be used to tie a removable upper thereto. Two slots are provided in the sole, one under the toes and one under the heel. The upper also has snaps that allow it to snap to the sole to hold it in place. This design is complicated, the laces do not reliably locate the foot or define the upper, and snaps are required to locate the upper.

U.S. Pat. No. 2,491,297 to Brown provides a piece of footwear having a sole with a slot through the sole position just forward of the heel and an upper that may be tied on with the lace in cooperation with an attachment eyelet between the toes of the user. Again, this is a complicated design. Also, the lace that ties the upper on does not define an upper and can only operate in cooperation with the between-the-toes eyelet.

U.S. Pat. No. 4,172,330 to Kao discloses a "flip-flop" or thong-like sandal wherein the upper straps are detachable from the sole. Vertical holes pass from the upper surface of the sole to the lower surface and the ends of the strap engage these holes. This design does not provide for reliable attachment between the straps and the lower, the straps require a complicated design, an attachment is forced between the user's toes, and the straps may not be easily interchanged.

U.S. Pat. No. 5,836,090 to Smith provides a sandal with the sole having upperwardly extending flanges with openings to receive laces. Again, this is a complicated design.

Several designs have been proposed wherein a detachable upper connects to a sole using snaps or other fasteners on the sides of the soles. A representative example is U.S. Pat. No. 4,461,102 to DeVincentis. These designs are typically complicated and provide a non-aesthetic appearance.

None of the various approaches has caught on as they have been overly complicated, functioned poorly, had poor aesthetics and/or were too expensive. Therefore, there remains a need for simple footwear that allows changes in appearance.

SUMMARY OF THE INVENTION

The present invention provides improved footwear that overcomes many of the limitations of the prior art.

A shoe according to an embodiment of the present invention has a sole member with an upper surface configured to receive a user's foot and a lower surface configured to contact a support surface. The sole member has a first side wall and a second side wall spaced from the first side wall. A slot extends between the first and second side walls and is spaced from the upper and lower surface of the sole member. The slot has an upper limit and a lower limit spaced apart by a slot height. The slot has a front edge and a rear edge spaced apart by a slot length. The slot has a slot shape as viewed from above.

The shoe includes a strap having an assembled position wherein the strap extends through the slot and forms a loop extending over the upper surface of the sole member such that the strap forms an upper for the shoe. The strap has a slot engaging portion that is generally disposed in the slot when the strap is in the assembled position. The slot engaging portion has a first thickness. The strap also has an exposed portion that is not disposed in the slot when the strap is in the assembled position. The majority of the exposed portion has a thickness substantially less than the first thickness. In some versions, the first thickness is at least 25% greater than the thickness of the majority of the exposed portion, and in other versions it is at least 50% greater.

In some versions, the slot engaging portion of the strap has a shape generally corresponding to the slot shape such that the slot engaging portion generally fills the slot when the strap is in the assembled position. In some versions, the first thickness is approximately the same as the slot height.

In some versions, the strap has an outer layer and an inner layer and the slot engaging portion of the strap further includes a forefoot pad disposed between the inner and outer layer. The forefoot pad may have a shape generally corresponding to the slot shape.

In some versions, the slot engaging portion of the strap is generally planar and the exposed portion of the strap is generally curved. The exposed portion of the strap may consist of two end portions joined to opposed sides of the slot engaging portion. These end portions may have a closure member for joining the end portions together to form the upper portion of the shoe. In this version, the end portions are each joined to the slot engaging portion at an angle between 60 and 150 degrees. Alternatively, the angle may be between 80 and 130 degrees, or between 90 and 120 degrees. The strap may be heat formed to provide the angles between the slot engaging portion and the end portions.

In some versions, the exposed portion of the strap further includes a strap feature disposed on an outer surface of the exposed portion. The strap feature and the exposed portion of the strap having a combined thickness that is less than or equal to the strap height. The strap feature may be a cord and the cord may form at least part of a closure member for the strap.

In some versions, the sole member comprises an outsole element and a midsole element. The outsole element has a bottom face forming the lower surface of the sole member and an opposed top face. The midsole element has a bottom face and an opposed top face forming the upper surface the sole member. The top face of the outsole element is at least partially joined to the bottom face of the midsole element to form the sole member.

In some versions, the strap has indicia on its inner surface indicating which edge should be directed toward the front of the sole when the strap is disposed in the slot. The indicia may be on the inner surface of the slot engaging portion.

In some versions, the sole member further includes a reinforcing member in the sole member adjacent the upper limit of the slot to reinforce the slot. Alternatively or additionally, the sole member may include a stiffening element adjacent the lower limit of the slot.

In some versions, the ends and the midportion of the strap may be said to have front and rear edges with a central axis defined midway between the edges and running lengthwise alone the strap. The closure member joins the opposed ends to form a loop having a forward and a rearward opening. This version of the strap is configured such that when the midportion is received in the slot and the closure member joins the opposed ends such that the central axes of the opposed ends are parallel, the strap forms a tapered loop with the rearward opening that is larger than the forward opening.

In some versions, the shoe includes a toe post element with a first end interconnected with the sole member and a second end including a strap engaging feature. The strap engaging feature engages the exposed portion of the strap when the strap is in the assembled position and the strap is removable by removing the strap from the slot and disengaging the strap engaging feature of the toe post element.

The strap engaging feature may be a toe post loop with the strap passing through the loop. The strap may have opposed ends that are joined together between the toe post loop and the slot.

The shoe may be said to have a toe region at the forward end and a heel region toward the rearward end, The toe post element may be disposed in the toe region while the slot may be defined through the sole member adjacent the heel region. The loop formed by the strap extends forwardly from the slot to engage the strap engaging feature of the toe post element.

A shoe according to another embodiment of the present invention has a sole member with an upper surface configured to receive a user's foot and a lower surface configured to contact a support surface. The sole member has a first side wall and a second side wall spaced from the first side wall, the side walls extending between the upper and lower surfaces. The sole member has a strap engaging feature. A toe post element has a first end interconnected with the sole member and a second end extending upwardly from the upper surface of the sole member. The second end includes a strap engaging feature. A strap has a sole member engaging portion and a toe post engaging portion. The strap has an assembled position wherein the sole member engaging portion is interconnected with the strap engaging feature of the sole member and the toe post encaging portion is interconnected with the strap engaging feature of the toe post element. The strap is removable from the sole member by disconnecting the strap from the strap engaging features of the sole member and the toe post element.

In some versions, the strap engaging feature of the sole member is a slot extending through the sole member from the first side wall to the second side wall. The sole member engaging portion of the strap is a portion of the strap that is disposed in the slot when the strap is in the assembled position. The strap may have a pair of opposed ends and a midportion extending therebetween. A closure member may join the opposed ends and the midportion of the strap may be received in and retained by the slot in the sole member when the strap is in the assembled position. The remainder of the strap forms a loop that extends over the upper surface when the opposed ends are joined and the strap engaging feature of the toe post engages the loop. The midportion of the strap may be generally flat and disposed generally in a plane when in the assembled position. The remainder of the strap includes exposed portions that are joined to the generally flat mid portion at an angle that extends forwardly with respect to the plane such that the exposed portions extend forwardly.

In some versions, the remainder of the strap includes a generally V-shaped portion where the toe post element engages the strap in the assembled position.

In some versions, the portion of the strap disposed in the slot has a thickness substantially greater than a thickness of the remainder of the strap.

The slot in the sole member has a front to back width and, in some versions, the majority of the strap has a front to back width that is generally the same as the width of the slot.

In some versions, the strap engaging feature of the sole member comprises connectors disposed on the sole member and the sole member engaging portion of the strap comprises elements on the strap that interconnect with the connectors. The connectors may comprise snap elements, and the strap may have a pair of ends with corresponding snap elements such that the snap elements cooperate to interconnect the strap and the sole member. The snap elements on the sole member may be disposed on the side walls of the sole member.

In some versions, the strap engaging feature of the toe post element is a toe post loop, and the strap extends through the toe post loop.

In other versions, the strap engaging feature of the toe post element is a snap element, and the strap has a corresponding snap element such that the snap elements cooperate to interconnect the strap and the toe post element.

The sole member may be said to have a toe region at a forward end and a heel region toward a rearward end. The toe post element may be disposed in the toe region and the strap engaging feature of the sole member may be disposed adjacent the heel region such that the strap extends forwardly from the strap engaging feature of the sole member to engage the strap engaging feature of the toe post element when the strap is in the assembled position. The strap engaging feature of the sole member may be a slot extending through the sole member from the first side wall to the second side wall, the slot being adjacent the heel region. The sole member engaging portion of the strap may be a portion of the strap that is disposed in the slot when the strap is in the assembled position.

Alternatively, the strap engaging feature of the sole member may comprise connectors disposed on the sole member adjacent the heel region and the sole member engaging portion of the strap may comprise elements on the strap that interconnect with the connectors.

The strap has a front edge and a rear edge. In some versions, the strap further includes an extended portion extending from the front edge of the strap to a forward end. The forward end of the extended portion defines the toe post engaging portion.

In some versions, the sole member comprises a plurality of layers including an outsole layer defining the lower surface, a footbed layer defining the upper surface, and at least one midsole layer disposed between the outsole and footbed layers, the plurality of layers being joined together to form the sole member. In some versions, the strap engaging feature of the sole member is a slot extending through the sole member from the first side wall to the second side wall. One of the midsole layers has a recess defined therein, the recess defining the slot through the sole member.

The strap may be a first strap, the shoe further comprising a second strap selectively replacing the first strap.

A shoe according to a further embodiment of the present invention includes a sole member having an upper surface configured to receive a user's foot and a lower surface configured to contact a support surface. The sole member has a first side wall and a second side wall spaced from the first side wall. The side walls extend between the upper and lower surfaces. The sole member includes an outsole element and a midsole element. The outsole element has a bottom face forming the lower surface of the sole member and an opposed top face. The midsole element has a bottom face and an opposed top face forming the upper surface the sole member. The top face of the outsole element is at least partially joined to the bottom face of the midsole element to form the sole member;

The sole member has a slot extending between the first and second side walls and being spaced from the upper and lower surface of the sole member. The slot has an upper limit defined by the bottom face of the midsole element and a lower limit defined by the top face of the outsole member.

The shoe also includes a strap with a pair of opposed ends and a midportion extending therebetween. The midportion is configured to be received in and retained by the slot. The strap includes a closure member for joining the opposed ends. When the midportion of the strap is received in the slot and the closure member joins the opposed ends, the strap and the sole member cooperate to form a shoe upper for receiving the foot.

In some versions, the midsole has a recessed area defined in the bottom face extending from one side of the midsole to the other side and defining the upper limit of the slot. A lining may be provided in the recessed area to reduce friction between the strap and the upper limit of the slot.

The midsole element may include a footbed defining the top face, with the footbed being a leather or synthetic material. In some versions, the midsole element is at least partially formed of cork and a binder.

In some versions, the strap has indicia on its inner surface indicating which edge should be directed toward the front of the sole member when the strap is disposed in the slot.

In some versions, the midsole element further includes a reinforcing member adjacent the upper limit of the slot to reinforce the slot. The sole member may include a stiffening element adjacent the lower limit of the slot.

In some versions, the ends and the midportion of the strap may be said to have front and rear edges with a central axis defined midway between the edges and running lengthwise along the strap. The closure member joins the opposed ends to form a loop having a forward and a rearward opening. This version of the strap is configured such that when the midportion is received in the slot and the closure member joins the opposed ends such that the central axes of the opposed ends are parallel, the strap forms a tapered loop with the rearward opening that is larger than the forward opening.

The outsole member and midsole member may be formed of generally different materials. For example, the outsole member maybe formed of polyurethane, rubber or a combination of polyurethane and rubber, and the midsole member is at least partially formed of a combination of cork and a binder or at least partially formed of ethylene vinyl acetate.

BRIEF DESCRIPTION OF THE DRAWINGS

FIG. 1 is a perspective view of an embodiment of a shoe according to the present invention with the opposed ends of an interchangeable strap interconnected to form the shoe's upper;

FIG. 3 is an end view of a strap for use with the present invention, with the ends of the strap joined;

FIG. 5 is a end view of another strap for use with the present invention;

FIG. 6 is a bottom view of the slot engaging portion of the strap of FIG. 5;

FIG. 7 is a perspective view of an alternative strap design including a cord as a strap feature;

FIG. 13 is a perspective view of an embodiment of a shoe according to the present invention, illustrating an alternative approach to interconnecting the toe post element and strap;

FIG. 14 is a detailed view showing the interconnection between the toe post element and the strap in FIG. 13;

FIG. 19 is a perspective view of a further embodiment of a shoe according to the present invention, wherein the strap engaging feature of the sole member comprises connectors on the side walls of the sole member; and FIG. 20 is a side elevational view of an embodiment of a shoe according to the present invention with a raised heel.

DETAILED DESCRIPTION OF THE PREFERRED EMBODIMENTS

Figure 2:
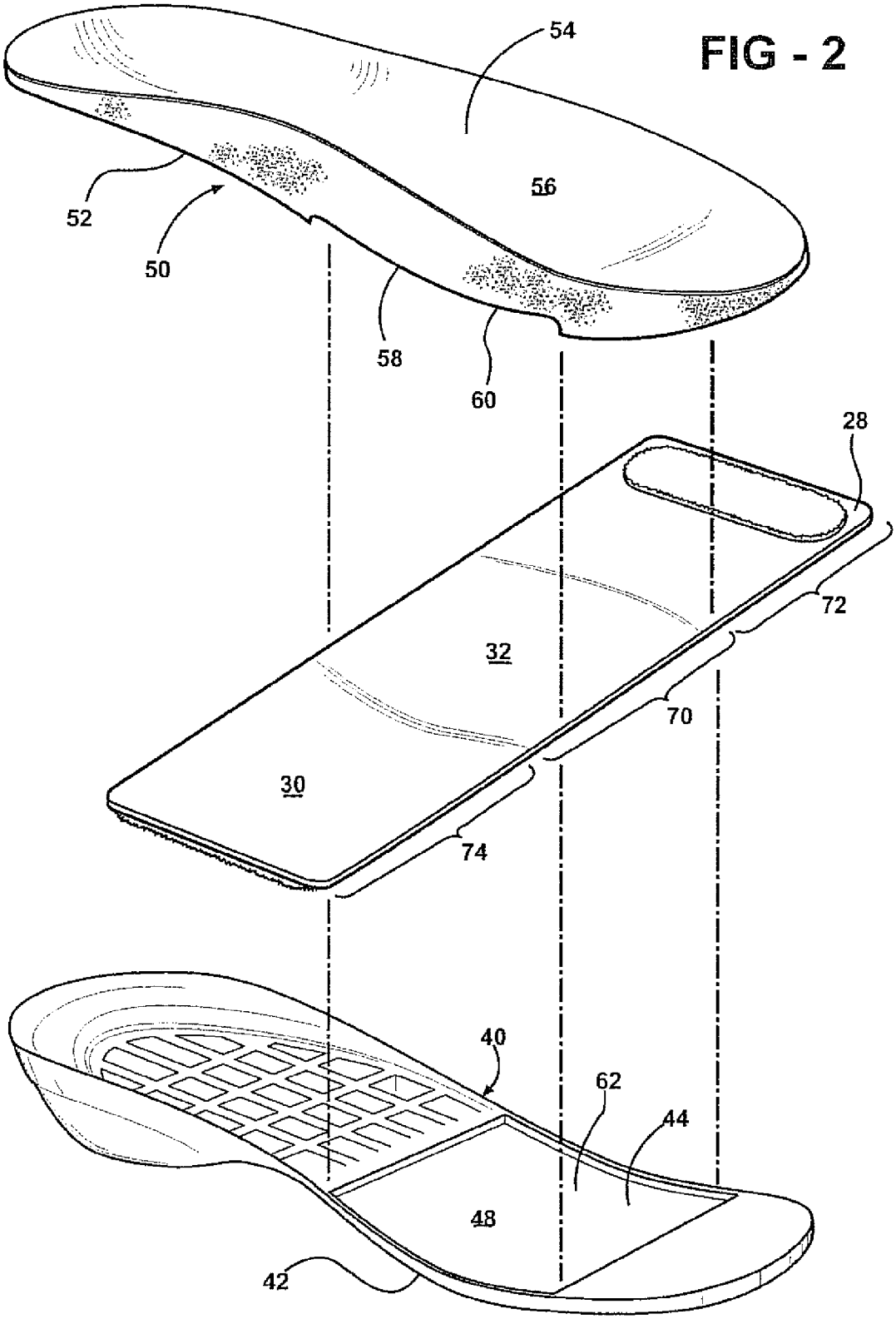
FIG. 2 is an exploded perspective view of a shoe according to an embodiment of the present invention.

Referring to FIGS. 1 and 2, a shoe according to the present invention is generally shown at 10. The shoe includes a sole member 12 with an upper surface 14 and a lower surface 16. In use, a user's foot is placed on the upper surface 14 and the lower surface 16 contacts a support surface, such as a floor or the ground. In some embodiments, the upper surface 14 is formed of a different material than the remainder of the sole member 12. In the illustrated embodiment, the upper surface has a leather footbed.

The sole member 12 may be said to have a pair of sidewalls 20 and 22 that extend between the upper surface 14 and lower surface 16 and are spaced apart from one another. Alternatively, the sidewalls 20 and 22 may be considered to be part of the same perimeter wall that determines the shape of the sole member in plan view. A slot 24 is defined through the sole member 12 and extends between the sidewalls 20 and 22. The sole member and the sidewalls 20 and 22 may have different shapes than illustrated.

A strap or strap member 26 is shown in FIG. 1 cooperating with the sole member 12 to define an upper for the shoe 10. Referring to FIGS. 1 and 2, the strap may be said to have a pair of opposed ends 28 and 30 with a mid-portion 32 between the opposed ends. As illustrated, when the sole member 12 and strap 26 are assembled, the mid-portion 32 of the strap is disposed in the slot 24 and the opposed ends 28 and 30 of the strap 26 are joined by a closure member. In the illustrated embodiment, the closure member is portions of hook and loop-type fastening material disposed on the ends 28 and 30 so that the ends may be joined. With the ends joined, the strap forms a loop extending from the sole member 12 for receiving the user's foot. In the illustrated embodiment, the closure member and the opposed ends are above the upper surface of the sole member. Alternatively, the ends and the closure member may be positioned in the slot or in a different position than shown. Once the ends of the strap are separated, the strap 26 may be removed from the slot 24. A different strap may then be substituted so as to alter the aesthetic appearance or fit of the shoe 10. It is noted that the strap 26 shown in FIG. 2 is illustrated as generally flat and rectangular, but it may have a different shape so as to provide the assembled shape shown in FIG. 1.

The general concept of the present invention is directed to the provision of a shoe sole with a side-to-side slot for receiving a removable strap, with the strap having ends that may be joined so as to form a shoe upper. The shoes illustrated in FIGS. 1 and 2 are merely representative of one possible configuration for a shoe according to the present invention. Numerous alternative versions also fall within the scope of the present invention. Different shoe designs which fall within the scope of the present invention will differ in certain details of their construction, but will include the common elements discussed above. Hereinbelow, specific embodiments of the present invention will be discussed in extensive detail. However, some or all of these details may apply only to the illustrated embodiments and be less applicable to other variations that fall within the scope of the present invention. It should be noted that throughout this application, shoe soles and straps have been illustrated only for one shoe out of a pair. As will be clear to those of skill in the shoe art, shoes are provided in pairs, including a right shoe and a left shoe, which are essentially mirror images of one another. By illustrating only a right or a left shoe, shoe sole, or strap, the present invention enables the construction and use of a right and a left shoe.

According to a preferred embodiment of the present invention, a variety of styles of shoe soles may be provided, along with straps having a variety of appearances. The various shoe sole designs may receive different strap designs so as to alter their appearance and/or fit. Likewise, some strap designs may be used with more than one shoe sole design. This interchangeability of straps and/or soles allows great flexibility in the use of the present invention.

Referring now to FIG. 2, the illustrated embodiment of the present invention has a sole member that is formed by an outsole element 40 and a midsole element 50. The outsole element 40 has a bottom face 42 that defines the lower surface of the sole member and is designed to contact the ground. The outsole element 40 has a top face 44 that is opposed to the bottom face. As shown, the overall outsole element may be said to be somewhat cup shaped. The outsole element may be formed of a variety of materials, with rubber being one material. In some embodiments, the outsole element may be constructed of more than one piece, such as a polyurethane, or other polymer, piece defining the majority of the outsole element and one or more rubber or rubber blend inserts attached thereto to form the traction surface on the bottom face 42. The midsole element 50 also has a bottom face 52 and an opposed top face 54, with the top face defining the upper surface of the sole member. The midsole element may be formed out of a variety of materials. In one version, the midsole element is mostly formed by a mix of cork particles and binder such as rubber, latex, polyurethane or TPR. TPR is a thermoplastic olefin consisting of some fraction of PP (polypropylene), PE (polyethylene), BCPP (block copolymer polypropylene), rubber, and a reinforcing filler, preferably with a high fraction of rubber (above 40%). In other embodiments, the perimeter of the midsole element is formed of a mix of cork particles and binder, while the central portion of the midsole is formed of a cushioning material such as EVA or Sponge EVA. EVA is polyethylene vinyl acetate, which is the copolymer of ethylene and vinyl acetate. The weight percent vinyl acetate usually varies from 10 to 40% with the remainder being ethylene. Sponge EVA is a blend of EVA with rubber. The cushioning material preferably had a density and durometer lower than the permiter material. In further embodiments, the perimeter of the midsole element is formed of a polymer, such as EVA, having a first density and durometer and the central portion is formed of a cushioning material with a lower density and durometer. This use of lower density and durometer material in the central region reduces the weight of the midsole element.

In some embodiments, the midsole element has a footbed topcover 56 that may be formed from a sheet of leather or synthetic material. The upper face 44 of the outsole element is joined to the bottom face 52 of the midsole element to form the sole member. The two elements may be joined to each other only in certain areas, and may be joined using heat bonding, adhesive, mechanical interconnection or other approaches.

Forming the sole member by joining two elements allows the slot to be formed between these two elements, providing the significant advantage of not needing to mold or otherwise form the slot through a unitary element. In the illustrated embodiment, the upper limit 60 of the slot is defined by the bottom face 52 of the midsole element and the lower limit 62 of the slot is defined by the top face 44 of the outsole element.

In the illustrated embodiment, the midsole element 50 has a recessed area 58 defined in the bottom face 52 with this recessed area defining the upper limit 60 of the slot. The recessed area 58 in the illustrated embodiment extends from one side of the midsole element to the other and has a generally constant height. Alternatively, other shapes may be provided, such as being somewhat curved such that there is less height in the middle of the recess. Alternatively or additionally, a recessed area may be provided in the top face 44 of the outsole element 40. In the illustrated embodiment, a recessed area 48 is provided in the top face 44 of the outsole element 40. However, unlike the recessed area 58, the recessed area 48 does not extend completely side to side. Instead, it extends between edges adjacent each side. This recessed area 48 defines part of the lower limit of the slot. Because it is recessed in between the sides, the slot has a height that is effectively greater in the middle than at the sides. Alternatively, the recessed area 48 may not be provided, it may have a different shape, or it may extend side to side. Still further, the recessed area 48 may be filled with an insert, such as a pad or stiffener.

In order to make insertion of the strap through the slot easier, a lining may be provided at the upper limit, lower limit or both limits of the slot. Such a lining may reduce the friction between the strap and slot. The lining may be provided in one or both recessed areas, or may not be present.

In some versions of the present invention, a reinforcing member, not shown, may be provided in the midsole element 50 adjacent the upper limit of the slot to reinforce the slot. Alternatively or additionally, a stiffening element may be provided adjacent the upper or lower limit of the slot in order to avoid collapse of the slot. In one version, a stiffening element is provided underneath the slot. Both the reinforcing member and the stiffening element are optional. The reinforcing member and/or stiffening element may also serve as a friction reducing lining.

As will be clear to those of skill in the art, if the strap 26 has a thickness that is similar to the height of the slot, it will be difficult to insert the strap through the slot, especially where the strap is formed from a very soft material like soft leather. However, making the slot substantially taller than the thickness of the strap means that the slot will be only partially filled, top to bottom, by the strap and the slot may be highly visible when the shoe is worn. According to a further aspect of the present invention, embodiments of the present invention may have straps with a thickened potion designed to fill the slot, while the remainder of the strap is thinner to fit easily through the slot and provide a good shoe fit and appearance.

Referring to FIGS. 2 and 3, the illustrated strap may be said to have a slot engaging portion, indicated at 70, that is generally disposed in the slot when the strap is in an assembled position. By "generally disposed" it is meant that the slot engaging portion 70 is mostly or entirely disposed in the slot, but it does not rule out the slot engaging portion extending somewhat out of the slot. The remainder of the strap may be referred to as an exposed portion, indicated at 72 and 74, that is not disposed in the slot when the strap is in the assembled position. In the illustrated version, the exposed portion consists of two end portions joined to opposite sides of the slot engaging portion and having a closure member for joining the opposed ends.

As shown in FIG. 3, the slot engaging portion 70 has a first thickness t1 while the exposed portion of the strap has a second thickness t2. The first thickness is greater than the second thickness. In some versions, the thickness t1 is approximately equal to the height of the slot, while the thickness t2 is substantially less, such as approximately 25% to 50% less than the thickness t1 and/or the slot height. This provides the benefit that the thinner portions of the strap, the exposed portions, may be inserted through the slot more easily. At the same time, the thicker slot engaging portion fills the slot sufficiently to give a good appearance and/or support the slot when weight is being supported on the footbed above the slot. Also, the thickness of the slot engaging portion stabilizes it in the slot thereby giving a more secure assembly. This acts somewhat as a positive locating feature such that a user knows when the strap is correctly positioned in the slot.

Figure 4:
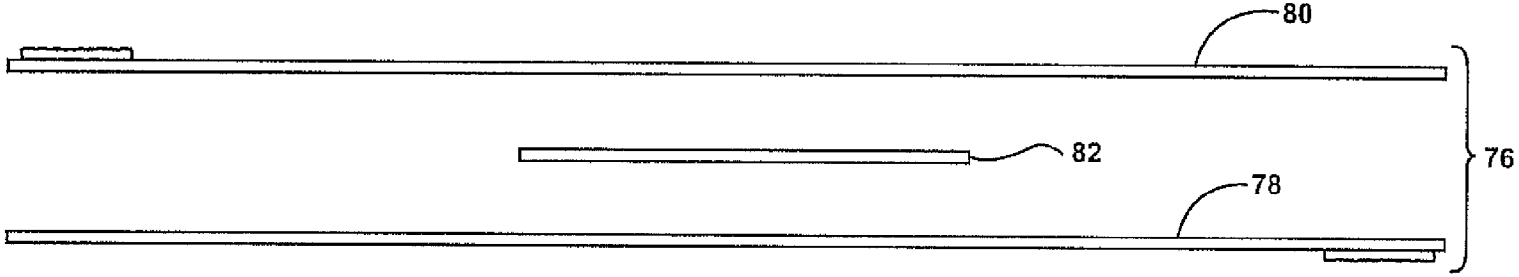
FIG. 4 is an exploded view of the strap of FIG. 3.

The strap may be formed in a variety of ways. FIGS. 3 and 4 illustrate one preferred approach to forming a strap 76, with the assembled strap shown in FIG. 3 and the components shown in FIG. 4. The strap has an outer layer 78 and an inner layer 80. In the illustrated embodiment, the layers 78 and 80 are generally coextensive, though this is not required. A forefoot pad 82 is disposed between the layers 78 and 80 in the slot engaging portion 70 of the strap, thereby making this portion thicker. In some embodiments the outer layer 78 is a high grade leather with a thickness of 1 to 2 mm, with 1.2-1.4 mm being more preferred.

The inner layer 80 in this embodiment is a pig skin, calf skin, leather or synthetic with a thickness of 0.5 to 1.5 mm, with 0.8 to 1.0 mm being more preferred. This creates a strap with a thickness in exposed portions of 1.5 to 3 mm, with 2-2.4 mm being more preferred. In this same embodiment, the forefoot pad 82 has a thickness of 2 to 4 mm such that the slot engaging portion 70 of the strap has a thickness of approximately 3.5 to 7 mm, which is approximately twice as thick as the exposed portions. It is preferred that the slot engaging portion have a thickness that is substantially greater than the thickness of the exposed portions. As used herein, "substantially thicker" means that the slot engaging portion has a thickness that is at least 25 percent greater than the exposed portion, with 50 percent greater being more preferred and 100 percent greater being more preferred.

The slot height in the sole member may vary, with some versions having a slot height of approximately 5.5 mm in the middle of the sole member. A height of 4-10 mm is preferred, with a height of 5 to 8 mm more preferred. It is preferred that the slot engaging portion of the strap has a thickness similar to the height of the slot. In this context, "similar thickness" means from 75 percent to 110 percent of the height.

Referring now to FIGS. 5 and 6, a preferred embodiment of a strap for use with the present invention is shown generally at 90. The strap shown in FIGS. 2-4 is illustrated as a flat strap with a generally constant width, front to back, and straight front and back edges. The preferred embodiment of the strap 90 is much more shaped. As shown, the slot engaging portion 92 is generally planar and is thicker than the remainder of the strap. The exposed portion is formed by two end portions 94 and 96. As shown, the exposed portion is generally curved. Again, the thickness of the exposed portion is substantially less than the thickness of the slot engaging portion.

The strap 90 may be heat formed after the various parts are assembled so that it takes on a shape that gives it a pleasing appearance and it fits the sole member well. It is preferred that the end portions 94 and 96 join the slot engaging portion at an angle Θ which is approximately a right angle. This causes the end portions 94 and 96 to be disposed close to the side walls of the sole member, thereby providing a pleasing appearance. The angle Θ is preferably close to a right angle, but may be in the range of 60 to 150 degrees, with 80 to 130 degrees being more preferred, and with 90 to 120 degrees being even more preferred. The angles at each side do not necessarily match each other. The angles Θ are measured with the end portions 94 and 96 joined to one another as they would be when the shoe is worn. This may be accomplished with a closure member such as hook and loop fastener material 98. As an alternative to heat forming the strap, the strap may be stitched and assembled such that the strap has the desired shape.

FIG. 6 shows a bottom view of the slot engaging portion 92 of a preferred strap configuration. As shown, indicia 100 may be provided on the strap to assist a user in correctly assembling shoes. The indicia may include which shoe, right or left, the strap is for and which side of the strap should point forward. The indicia may take various forms while still indicating how the strap should be positioned. In the illustrated embodiment, the indicia are on the outer surface of the slot engaging portion of the strap, though it may be provided elsewhere. The illustrated strap is a left foot strap.

FIG. 6 also illustrates a preferred shape for the slot engaging portion of the strap. As shown, the slot engaging portion may have a front to back width that is wider on one side of the shoe than the other. The slot may have a similar shape when viewed from above. In one preferred version, the slot and slot engaging portion are both wider on the medial (inner) side 102 than the lateral (outer) side 104 such that both taper from one side to the other. By way of example, one version tapers such that the medial side is approximately 10 percent wider than the lateral side. In versions with this taper, the strap is preferably inserted from the medial side and when fully inserted the edges of the strap engage the edges of the slot and the strap is securely positioned. Alternatively, the slot and strap may taper the opposite direction, or no taper may be used.

As also shown in FIG. 6, the strap is shaped so as to fit the sole member very closely when viewed from above, as well as from the front or back. To give the strap the right silhouette, gussets 106 may be provided in various areas of the slot engaging portion 92. Other approaches to shaping may also be used. As one alternative the outer and/or inner layers may be formed of three pieces, with one piece corresponding to the slot engaging portion and the other two pieces corresponding to the exposed portions. The pieces may be shaped and joined so as to provide the desired three dimensional shape. Further, this approach allows the use of less expensive materials in for the portion of the strap that will be disposed in the slot. For example, on straps where the outer surface is leather, making the outer surface from three pieces allows the use of a synthetic material, preferably matching, for the middle piece.

Referring now to FIG. 7, an alternative strap design is shown at 110. This strap differs from the version of FIG. 5 in that the strap includes a strap feature in the form of a cord 112 on the outer surface of the strap that makes the strap locally thicker. The cord 112 may be disposed under the outer layer of leather or material and still be considered to be disposed on the outer surface. Preferably, the combined thickness of the exposed portion 114 of the strap and the strap feature is less than or approximately equal to the thickness of the slot engaging portion 116 and/or the slot height of a corresponding sole member. As such, the strap with the strap feature may be assembled to a sole member by inserting the portion of the strap with the strap feature through the slot. With this design, the majority of the exposed portion 114 of the strap 110 still has a thickness that is substantially less than the thickness of the slot engaging portion. The strap 110 is also illustrated as having indicia 100 indicating correct assembly, with the indicia provided on the inner surface, which is a preferred position.

The cord 112 of the strap 110 extends to form a loop 118 which engages a button or toggle 120 to serve as a closure member. The strap may also include hook and loop fastener material where the ends of the strap overlap to provide additional retention.

Figure 8:
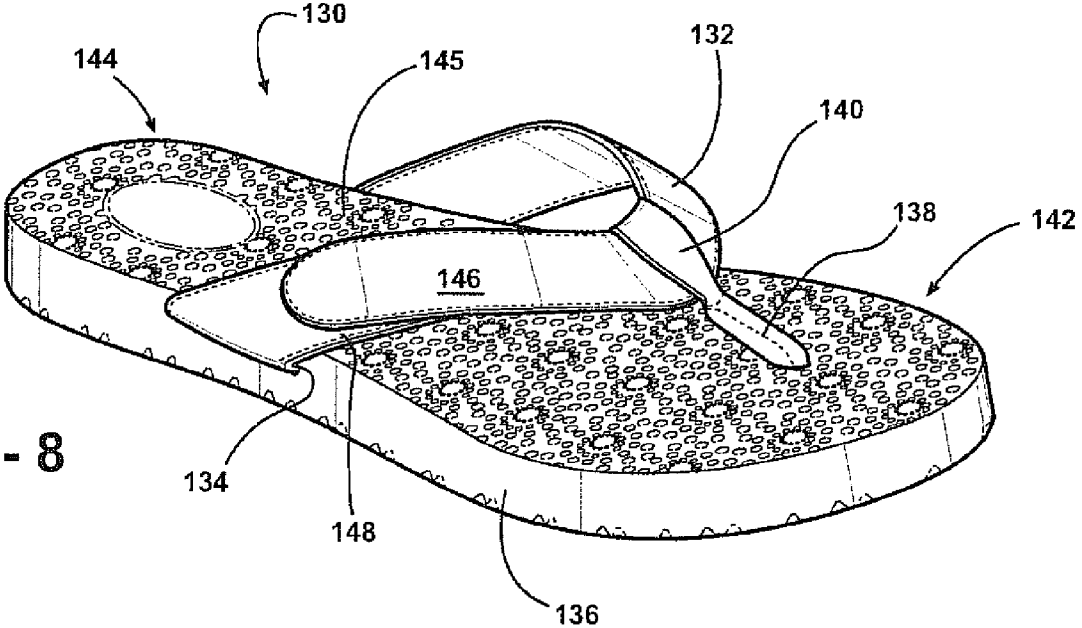
FIG. 8 is a perspective view of another embodiment of a shoe according to the present invention.

Referring again to FIG. 1, it can be see that when the ends of the strap 26 are joined, and the midportion of the strap is disposed in the slot, the strap forms a tapered loop with a rearward opening larger than the forward opening. Put another way, the end portions and midportion may be said to have front and rear edges and a central axis is defined along the strap midway between these edges. If the two end portions are joined together with their central axes generally aligned, the strap has a rearward opening larger than the forward opening. Alternatively, other shapes may be provided Referring now to FIG. 8, a thong style shoe with an interchangeable strap is generally shown at 130. This shoe represents a further embodiment of the present invention. As with the earlier embodiments, the shoe 130 has a strap 132 that extends through a slot 134 defined in the sole member 136. Unlike the earlier embodiments, the shoe 130 also includes a toe post element 138 that has a first end interconnected with the sole member 136 and a second end that extends upwardly. The second end includes a strap engaging feature 140 that engages the strap 132, thereby forming a thong style shoe. Preferably, the strap engaging feature is a loop and the top post element is woven or other flexible material. The toe post element may be permanently interconnected with the sole member or may be changeable so as to coordinate with the straps. In one approach, the toe post element extends through the sole member and terminates in a button or head that is received in a recess in the bottom of the sole member. The toe post element may be pulled downwardly out of the sole member and then a different one inserted.

Figure 10:
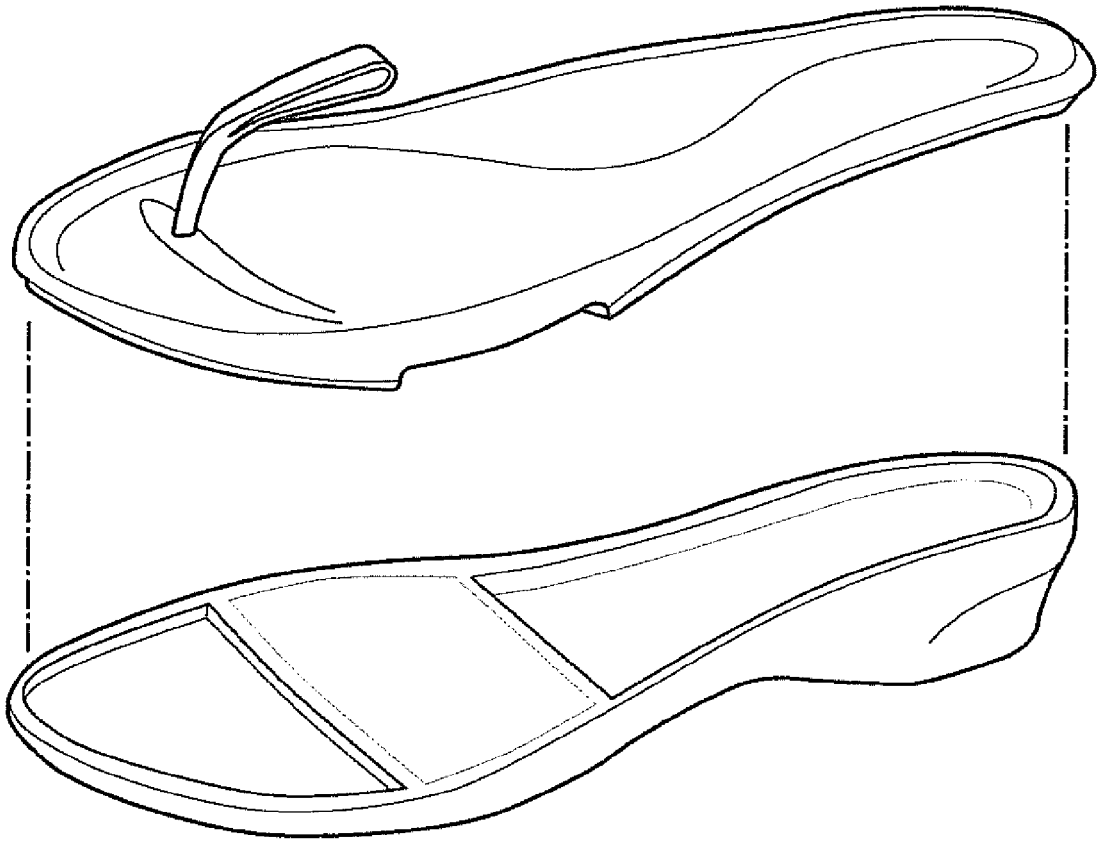
FIG. 10 is an exploded perspective view of a further embodiment of a shoe according to the present invention, the shoe having a slot and a toe post both at the forward end of the shoe, the shown without an upper.

The shoe 130 may take a variety of forms. In the illustrated embodiment, the sole member may be said to have a toe region 142 and a heel region 144 corresponding to the areas where the toes and heel, respectively, of a user's foot would be positioned when wearing the shoe. In this embodiment, the slot 134 is defined through the sole member 136 adjacent the heel region 144 and the toe post element is interconnected with the sole member in the toe region 142. Alternatively, the slot 134 may be positioned in a different area, such as farther forward. In one example, the slot may be in a position similar to the shoe of FIG. 1 with a strap shaped so as to engage a toe post element extending from the toe region of the sole member. FIG. 10 illustrates one example of a thong style shoe with a strap close to the front and a toe post element with a loop for receiving the strap. FIG. 10 also illustrates that the shoe may be constructed differently than with the earlier embodiments. As a further example, the slot may be between these two positions, or may be farther rearward than illustrated in FIG. 8. In the illustrated embodiment, the loop formed by the portion of the strap not in the slot extends forwardly over the upper surface of the sole member and passes through the loop 140 in the toe post element 138.

As with the earlier embodiments, the strap 132 may be said to have a portion that is disposed in the slot 134 and acts as a slot engaging portion. In the illustrated embodiment, the strap 132 has opposed ends 146 and 148 that are joined together with a closure member such as hook and loop fastener material. The interconnection between the opposed ends is disposed between the slot 134 and the strap engaging feature 140 on the outer (lateral) side of the shoe. The closure member may allow for some adjustment in strap length. This is also true for earlier embodiments. The opposed ends may alternatively be joined in a different location, such as within the slot.

A thong style shoe, with a slot and a strap engaging feature on a toe post element, may be formed in a variety of ways. For example, the slot may be formed between a midsole element and an outsole element as in the earlier embodiments. Alternatively, the slot may be molded into a molded sole member. In the illustrated embodiment, as best shown in the exploded view of FIG. 9, the sole member may be formed from a plurality of layers, including an outsole layer 150, a footbed layer 152 and one or more midsole layers 154 that are disposed between the outsole and footbed layers. These layers are stacked and joined together to form the sole member. In the illustrated embodiment, the midsole layers 154 include a partial layer 156 and a complete layer 158. The partial layer 156 extends under the heel region and only part way to the front of the shoe, thereby giving a slight taper to the sole member. The complete layer 158 is coextensive with the footbed layer 152 and outsole layer 150. Additional inserts, layers or partial layers may be provided to increase the thickness of the shoe and/or add shape, such as providing a heel cup or arch. In this embodiment, the partial layer 154 has a section missing to form the slot. This provides a very simple way to form the slot without complicated molding. As will be clear to those of skill in the art, the slot may be formed in other ways, such as by forming a notch in one of the layers. The missing section may be in a different layer or in multiple layers. As a further alternative, the midsole layers 154 may be molded with the slot molded as a notch therein. The slot is illustrated as having a constant cross section. Alternatively, the slot may have a widened area midway between the sides of the sole member, as represented by the dotted lines at 160. This shape may assist in allowing the strap to be inserted by allowing the bent portion to extend into the widened area and more easily "turn the corner". This is optional.

The slot may be reinforced or stiffened by disposing a reinforcing rectangular tube in the slot, by adding a soft or rigid layer above or below the slot, or in other ways. However, a reinforcement or stiffener is optional. In one embodiment, the footbed layer is molded with a reinforcement/stiffener molded into the lower surface of the footbed layer, so that the reinforcement/stiffener is disposed above the slot.

As with earlier embodiments, the portion the strap 132 that is disposed in the slot 134 in the sole member 136 may be thicker as compared to the remainder of the strap so as to fill the slot. Alternatively, the strap may have a generally constant thickness and/or the slot engaging portion may fit somewhat loosely in the slot.

Figure 9:
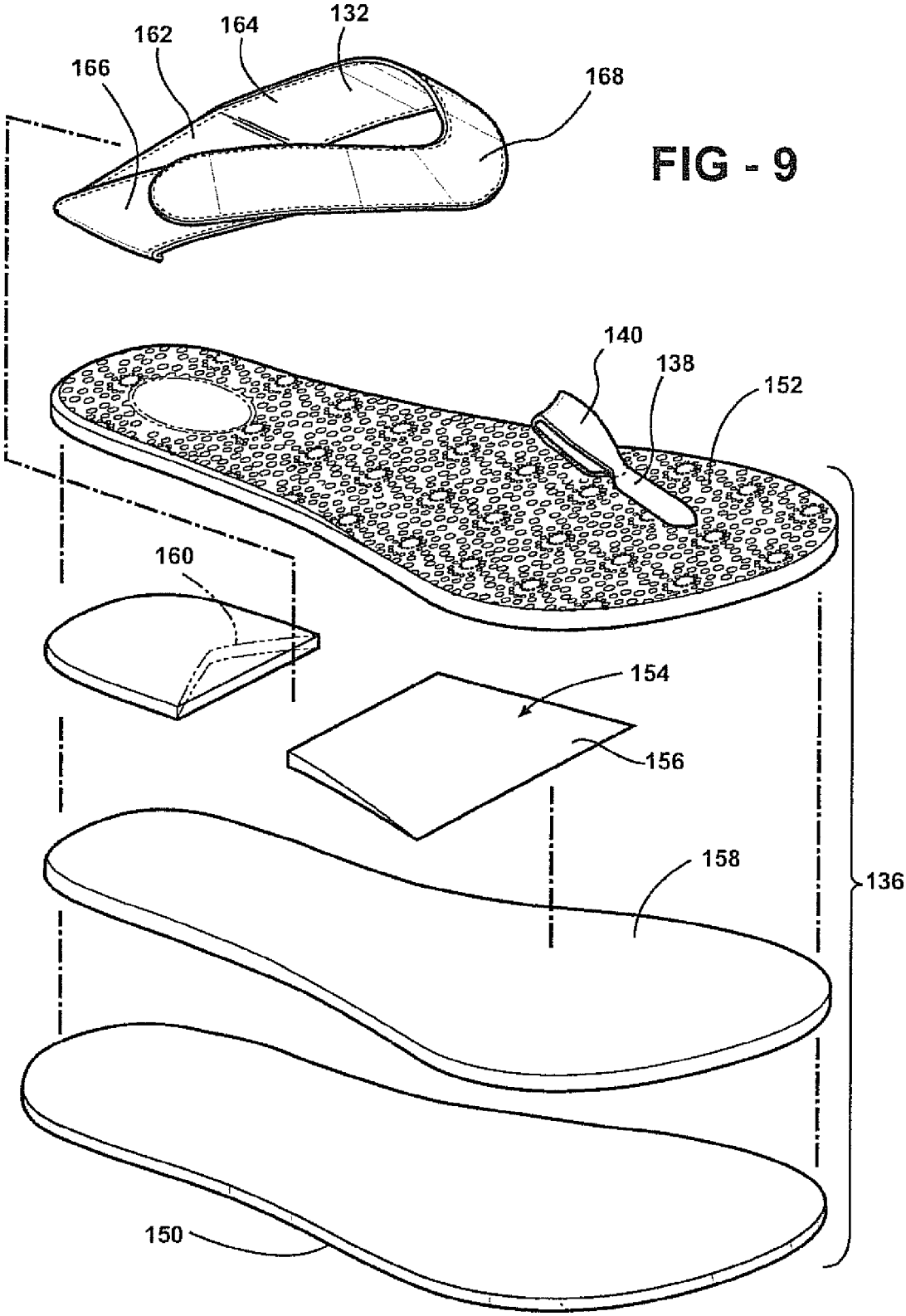
FIG. 9 is an exploded perspective view of one version of the shoe shown in FIG. 8.

The strap 132 in FIG. 9 illustrates one preferred configuration. As illustrated, the strap has a slot engaging portion 162 which is generally flat. It may be thicker than the remainder of the strap and/or may have indicia on it to indicate correct assembly. The remainder of the strap 132 includes portions 164 and 166 that join the slot engaging portion 162 at an angle, as viewed from behind. The angle may be as described with reference to FIG. 5. As also shown, the portions 164 and 166 are bent or angled forwardly with respect to a plane containing the slot engaging portion 162. The strap 132 also includes a forward portion 168 that is generally V-shaped. When the strap is passed through the loop 140 in the toe post element 138, the V-shape helps to locate the loop at the forwardmost point of the strap.

Referring again to FIG. 8, the sole member 136 may be said to have a mid-region 145 adjacent the heel region. In typical flip-flop style shoes, this area is wide and the straps engage the upper surface of the sole member. In the present invention, it is preferred that the strap extend from the sides of the sole member 136 but still conform closely to a user's foot. As such, the mid-region 145 is substantially narrower than for typical shoes of this size.

Figure 11:
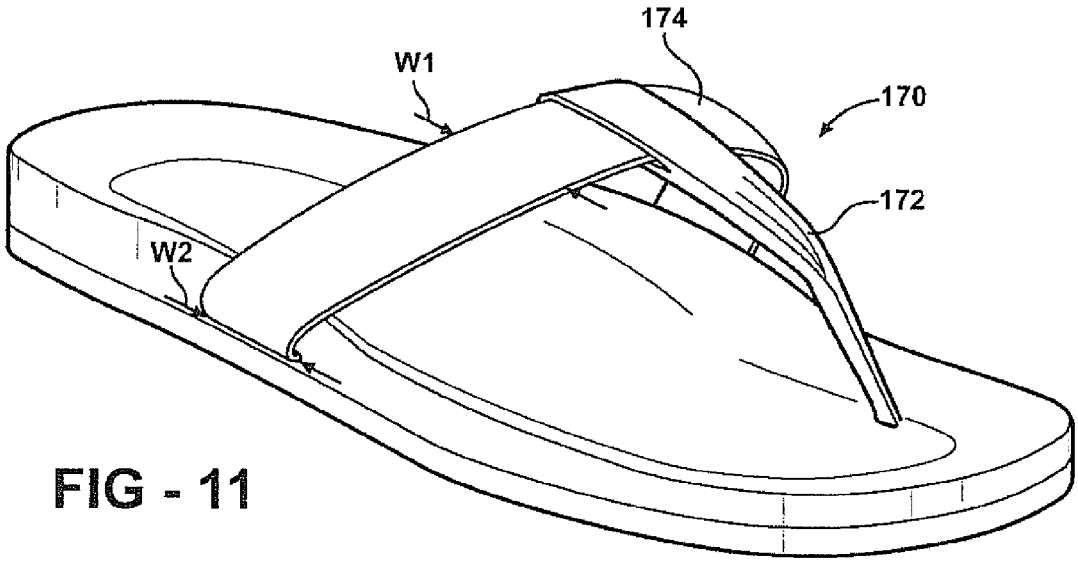
FIG. 11 is a perspective view of an embodiment of a shoe according to the present invention, the shoe having an elongated toe post with a loop engaging the strap.

Referring now to FIG. 11, another embodiment of a shoe according to the present invention is generally shown at 170. This embodiment differs from earlier embodiments in that the toe post element 172 is extended and engages the strap 174 much further rearward than with the embodiments of FIGS. 8 and 10. Also, the strap 174 has a generally constant front to back width w1. This width is similar to the front to back width w2 of the slot through the sole. By generally constant, it is meant that the front to back width w1 of the strap 174 is in the range of 80% to 120% of the average front to back width. The portion of the strap 174 disposed in the slot also falls within this range. As with earlier embodiments, it is preferred that the portion of the strap 174 disposed on the slot is substantially thicker than the remainder of the strap and similar in thickness to the slot. While not shown, the strap may have opposed ends that are joined to each other in any position and in any way disclosed herein.

Figure 12:
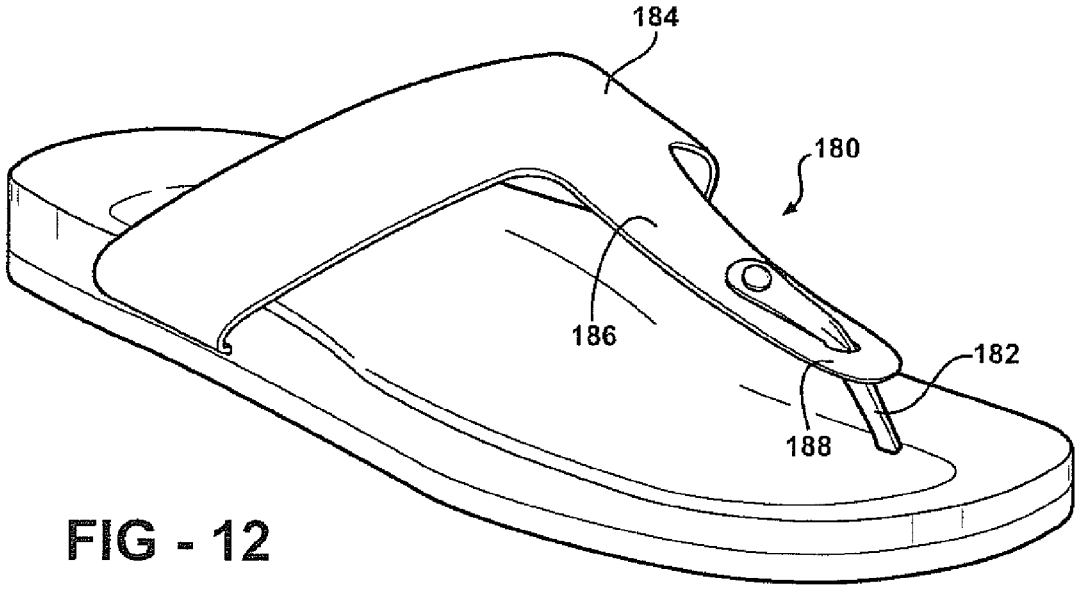
FIG. 12 is a perspective view of an embodiment of a shoe according to the present invention, the shoe having an extended portion extending from the band and a toe post engaging the extended portion.

Referring now to FIG. 12, a further embodiment of a shoe according to the present invention is shown at 180. This embodiment is similar to the embodiment of FIG. 11 in that the strap 184 has a generally constant front to back width. However, the strap 184 also includes an extended portion 186 that extends from the front edge of the strap 184 to a forward end 188. As such, when the strap is in the assembled position and the shoe is on a user's foot, the extended portion extends down the top of the foot towards the toes. In this embodiment, the extended portion has a hole therethru and the toe post element extends through this hole and snaps or otherwise fastens to an upper surface of the extended portion 186.

Figure 15:
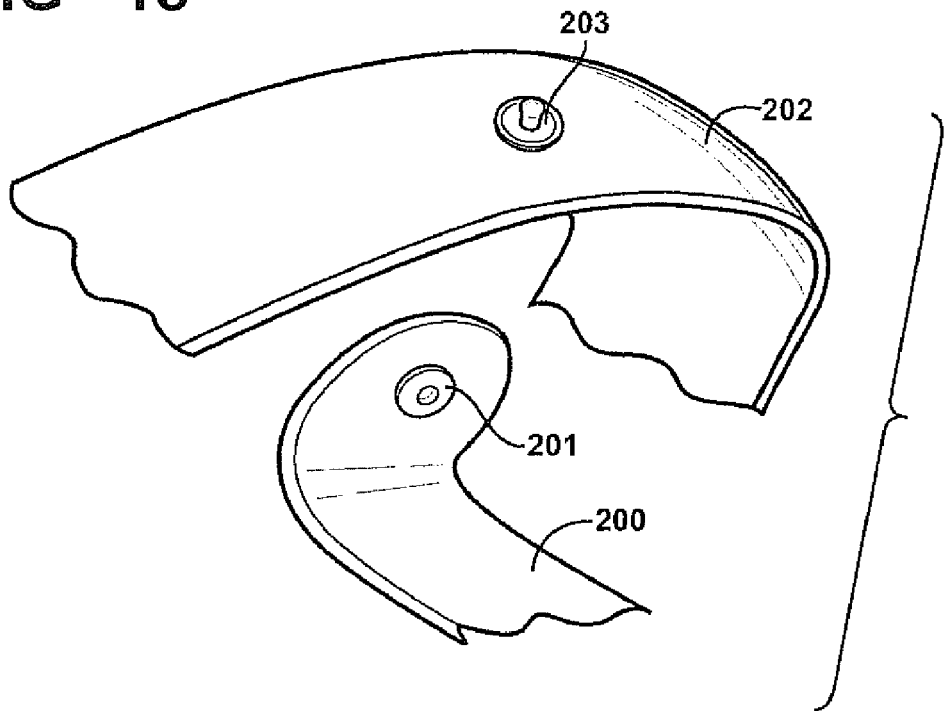
FIG. 15 is a detailed view of a portion of a shoe according to the present invention, illustrating another approach to interconnecting the toe post element and the strap.

Referring now to FIG. 13, another alternative embodiment of a shoe according to the present invention is shown at 190. This embodiment is similar to the embodiment of FIG. 11, except that the toe post element 192 has a snap element 193 that serves as the strap engaging feature of the toe post element. FIG. 14 provides a detailed view of the snap element 193 and a corresponding snap element 195 on the strap 194. The snap elements 193 and 195 cooperate to interconnect the toe post element and the strap FIG. 15 illustrates an alternative strap engagement approach. Again, the toe post element 200 has a snap element 201, but in this embodiment the element 200 passes under the strap 202, folds over the top of it, and engages the snap element 203 on the top of the strap.

Figure 16:
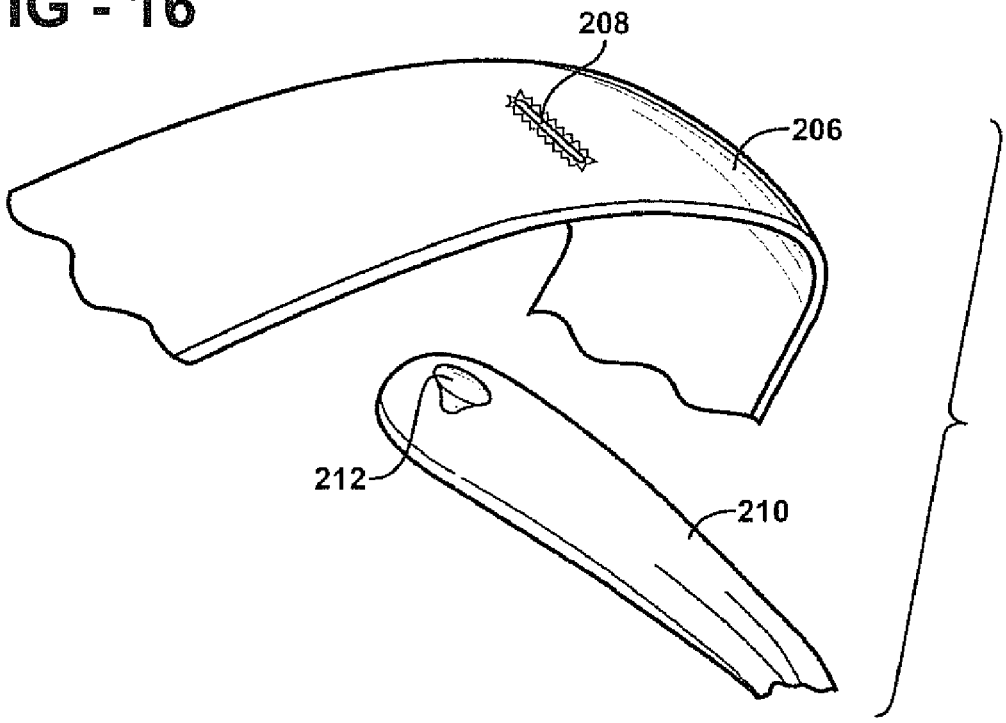
FIG. 16 is a detailed view of a portion of a shoe according to the present invention, illustrating another alternative approach to interconnecting the toe post element and the strap.

FIG. 16 illustrates a strap engagement approach wherein the strap 206 has an opening 208 like a button hole defined therein and the toe post element 210 has a button-like element 212 that extends through the opening 208 from the underside.

Figure 17:
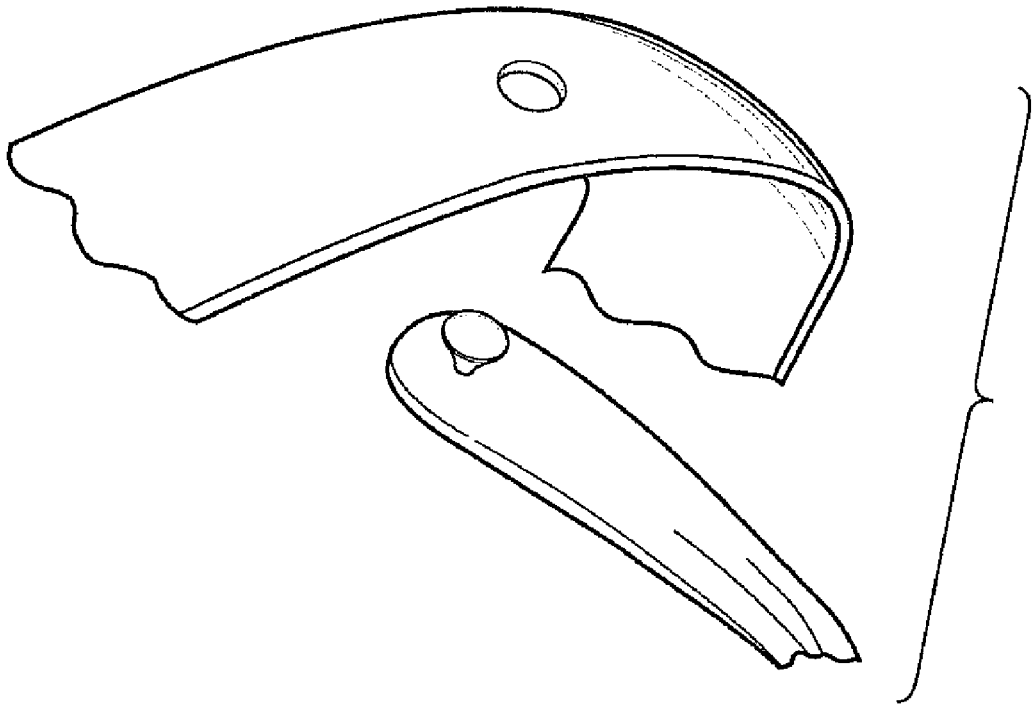
FIG. 17 is a detailed view of a portion of a shoe according to the present invention, illustrating a further alternative approach to interconnecting the toe post element and the strap.

FIG. 17 illustrates a similar approach where the opening is round and the button like element is rounded.

Figure 18:
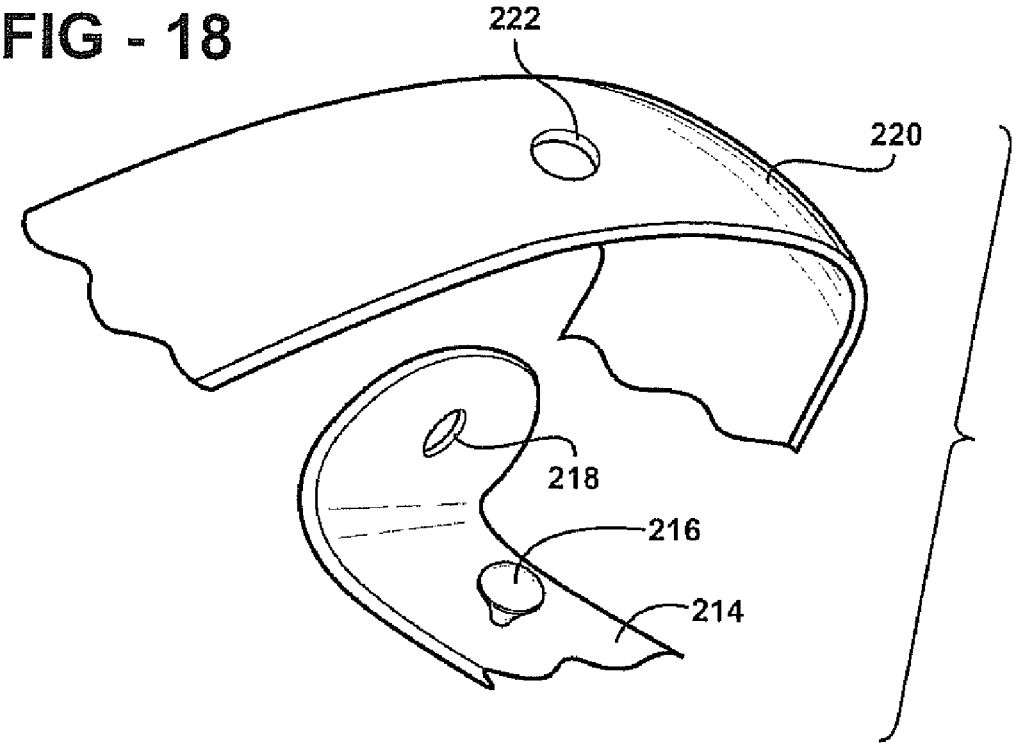
FIG. 18 is a detailed view of a portion of a shoe according to the present invention, illustrating yet another alternative approach to interconnecting the toe post element and the strap.

FIG. 18 illustrates an alternative approach wherein the toe post element 214 has a button-like element 216 and, further towards the end of the toe post, a corresponding opening 218. The strap 220 has an opening 222. The toe post element 214 extends under the strap 220 and the button-like element 216 is positioned through the hole 222 in the strap 220. The end of the toe post element is folded over the top of the strap 220 and the button-like element 216 is passed through the opening 218 in the end of the toe post element, thereby interconnecting the strap and toe post element.

Alternatives on the illustrated engagement approaches include providing a button like element that may be detached, such as by unscrewing or unsnapping and using this element to engage an opening in the strap or toe post element. Other alternatives are also possible.

Any strap engaging feature of any toe post element disclosed herein may be used with any of the embodiments of the present invention, whether illustrated or not.

Referring now to FIG. 19, an embodiment of a shoe according to the present invention is shown at 230. This embodiment is similar to the embodiment of FIG. 12, except that the strap engaging feature of the sole member 232 comprises connectors 234 rather than a slot. The connectors may be snaps that are disposed on the side walls of the sole member 232. The strap 236 may have corresponding snap elements that interconnect with the sole member. The shoe is illustrated with an extended portion 238, but may take any of the other forms shown herein. FIG. 20 illustrates another shoe 240 according to an embodiment of the present invention. The shoe uses the connectors of FIG. 19 to connect the strap 242 to the sole member 244. Alternatively, a slot may be provided. As shown, the shoe has a higher heel than previously illustrated embodiments.

Numerous alternative designs of shoes with interchangeable straps or uppers fall within the scope of the present invention. While in the illustrated preferred embodiments, each shoe is illustrated as having a single slot for use with a single strap, designs may also be provided wherein two or more slots may be provided in the sole. A single strap may be used which is placed in one of the available slots, or multiple straps may be provided with one strap engaging each slot.

The illustrated embodiments disclose the use of a single strap. However, additional straps may be provided with more than one strap engaging a single slot. For example, a wide slot may have room for two or more straps side-by-side. Alternatively, straps may be stacked on top of each other with more than one strap engaging the foot.

The straps as previously discussed each include closure members for joining the opposed ends of the strap to one another. As an alternative, a strap may be provided that is sufficiently flexible and elongated to allow the ends to be tied to each other, as would be done with a lace or scarf.

As will be clear to those of skill in the art, the preferred embodiments of the present invention may be altered in various ways without departing from the scope or teaching of the present invention. For example, the slot extending through the sole may be altered in various ways. The slot may be curved side-to-side, front to back, or up to down as it passes through the sole. The slot may have a different cross section than illustrated, such as oval, round, diamond-shaped, or others. The slot may taper upwardly near the sides to more closely conform the strap to the foot. That is, near the edges, the slot may curve upwardly or taper upwardly so as to bring the slot entrance or exit nearer to the upper surface.

Some of the applicants of the present application are the inventors of record of several prior applications and patents, including U.S. Pat. Nos. 7,174,657, 7,162,814, and 6,792,696; U.S. Design Pat. Nos. D467,407, D467,407, D470,304, D514,778, D514,780, and D535,085; and pending U.S. patent application Ser. No. 11/674,335, filed Feb. 13, 2007. In addition, applicants are the inventors of multiple co-pending design patent applications, including U.S. Design patent application Ser. Nos. 29/320,858, 29/320,860, 29/320,862, and 29/320,865, all filed Jul. 7, 2008. Each of these applications and patents is incorporated herein in their entirety. The inventions disclosed in the present specification are improvements on these earlier applications and patents. However, any of the teachings presented in these earlier applications and patents may be combined with the teachings of the present specification.

The shoe sole and strap drawings provided herein, and in the design patent applications incorporated herein by reference, are scale drawings of some embodiments of the present invention. Therefore, sizes of various elements, and ratios and relationships, may be determined for these embodiments by measuring the corresponding elements in the drawings. However, the present invention is not limited to the embodiments illustrated, or the measurements or ratios attainable from the drawings. Further, any feature of any embodiment shown herein or shown in the incorporated applications may be combined with any other feature of any other embodiment. As a non-limiting example, any of the toe post engagement features may be used with any of the bases or straps disclosed for any embodiment.

As will be clear to those of skill in the art, the herein described embodiments of the present invention may be altered in various ways without departing for the scope or teaching of the present invention. It is the following claims, including all equivalents, which define the scope of the present invention.

We claim:

1. A shoe with an interchangeable strap, comprising:

a sole member having an upper surface configured to receive a user's foot and a lower surface configured to contact a support surface, the sole member further having a first side wall and a second side wall spaced from the first side wall, the side walls extending between the upper and lower surfaces;

the sole member having a slot defined therethrough, the slot extending between the first and second side walls and being spaced from the upper and lower surface of the sole member, the slot having an upper limit and a lower limit spaced apart by a slot height, the slot having a front edge and a rear edge spaced apart by a slot length, the slot having a slot shape as viewed from above;

a strap having an assembled position wherein the strap extends through the slot and forms a loop extending over the upper surface of the sole member such that the strap forms an upper for the shoe, the strap having a slot engaging portion that is generally disposed in the slot when the strap is in the assembled position, the slot engaging portion having a first thickness, the strap further having an exposed portion that is not disposed in the slot when the strap is in the assembled position, the majority of the exposed portion having a thickness substantially less than the first thickness;

a toe post element having a first end interconnected with the sole member and a second end extending upwardly from the upper surface of the sole member, the second end including a strap engaging feature;

wherein the strap engaging feature engages the exposed portion of the strap when the strap is in the assembled position; and wherein the strap is removable from the sole member by removing the strap from the slot and disengaging the strap from the strap engaging feature.

2. The shoe according to claim 1, wherein the first thickness is at least 25% greater than the thickness of the majority of the exposed portion.

3. The shoe according to claim 2, wherein the first thickness is at least 50% greater than the thickness of the majority of the exposed portion.

4. The shoe according to claim 1, wherein the slot engaging portion of the strap has a shape generally corresponding to the slot shape such that the slot engaging portion generally fills the slot when the strap is in the assembled position.

5. The shoe according to claim 1, wherein the slot engaging portion of the strap is generally planar and the exposed portion of the strap is generally curved.

6. The shoe according to claim 5, wherein the exposed portion of the strap comprises two end portions joined to opposed sides of the slot engaging portion, the end portions having a closure member for joining the end portions together to form the upper portion of the shoe, the end portions each joined to the slot engaging portion at an angle between 60 and 150 degrees.

7. The shoe according to claim 6, wherein the strap is heat formed to provide the angles between the slot engaging portion and the end portions.

8. The shoe according to claim 6, wherein the end portions are joined to the slot engaging portion at an angle between 80 and 130 degrees.

9. The shoe according to claim 6, wherein the end portions are joined to the slot engaging portion at an angle between 90 and 120 degrees.

10. The shoe according to claim 1, wherein the exposed portion of the strap further includes a strap feature disposed on an outer surface of the exposed portion, the strap feature and the exposed portion of the strap having a combined thickness that is less than or equal to the slot height.

11. The shoe according to claim 1, wherein the strap engaging feature of the toe post element is a toe post loop, the strap extending through the toe post loop when the strap is in the assembled position.

12. The shoe according to claim 1, wherein the strap has a pair of opposed ends that are joined together to form a loop, the opposed ends being joined together between the strap engaging feature and the slot.

13. The shoe according to claim 1, wherein the strap has an inner surface, an outer surface, and a front and rear edge, the inner surface having indicia thereon indicating which edge should be directed toward the front of the sole member when the strap is disposed in the slot.

14. The shoe according to claim 1, wherein the sole member further comprises a reinforcing member in the sole member adjacent the upper limit of the slot to reinforce the slot.

15. The shoe according to claim 1, wherein the first thickness is approximately the same as the slot height.

16. The shoe according to claim 1, wherein the strap comprises an outer layer and an inner layer, the slot engaging portion of the strap further having a pad disposed between the inner and outer layer.

17. The shoe according to claim 16, wherein the pad has a shape generally corresponding to the slot shape.

18. The shoe according to claim 1, wherein the sole member comprises an outsole element and a midsole element, the outsole element having a bottom face forming the lower surface of the sole member and an opposed top face, the midsole element having a bottom face and an opposed top face forming the upper surface the sole member, the top face of the outsole element being at least partially joined to the bottom face of the midsole element to form the sole member, the upper limit of the slot being defined by the bottom face of the midsole element and the lower limit of the slot being defined by the top face of the outsole member.

19. The shoe according to claim 18, wherein the outsole member and the midsole member are formed generally of different materials.

20. The shoe according to claim 1, wherein the sole member has a toe region at a forward end and a heel region toward a rearward end, the toe post element being disposed in the toe region and the slot being defined through the sole member adjacent the heel region, the loop formed by the strap extending forwardly from the slot to engage the strap engaging feature of the toe post element.

21. A shoe with an interchangeable strap, comprising:

a sole member having an upper surface configured to receive a user's foot and a lower surface configured to contact a support surface, the sole member further having a first side wall and a second side wall spaced from the first side wall, the side walls extending between the upper and lower surfaces, the sole member having a strap engaging feature, the strap engaging feature being a slot extending through the sole member from the first side wall to the second side wall;

a toe post element having a first end interconnected with the sole member and a second end extending upwardly from the upper surface of the sole member, the second end including a strap engaging feature; and a strap having a sole member engaging portion and a toe post engaging portion, the strap having an assembled position wherein the sole member engaging portion is interconnected with the strap engaging feature of the sole member and the toe post engaging portion is interconnected with the strap engaging feature of the toe post element, the sole member engaging portion of the strap being a portion of the strap that is disposed in the slot when the strap is in the assembled position;

wherein the portion of the strap disposed in the slot has a thickness substantially greater than a thickness of the remainder of the strap; and wherein the strap is removable from the sole member by disconnecting the strap from the strap engaging features of the sole member and the toe post element.

22. The shoe according to claim 21, wherein the strap has a pair of opposed ends and a midportion extending therebetween, the strap further having a closure member for joining the opposed ends, the midportion of the strap being received in and retained by the slot in the sole member when the strap is in the assembled position, the remainder of the strap forming a loop that extends over the upper surface when the opposed ends are joined, the strap engaging feature of the toe post engaging the loop.

23. The shoe according to claim 22, wherein the midportion of the strap is generally flat and disposed generally in a plane when in the assembled position, the remainder of the strap including exposed portions joined to the generally flat mid portion, the exposed portions joining the flat portion at an angle that extends forwardly with respect to the plane such that the exposed portions extend forwardly.

24. The shoe according to claim 23, wherein the remainder of the strap includes a generally V-shaped portion, and the strap engaging feature of the toe post element engages the strap generally in a center of the V-shaped portion in the assembled position.

25. The shoe according to claim 21, wherein the slot in the sole member has a front to back width, the majority of the strap having a front to back width generally the same as the width of the slot.

26. The shoe according to claim 21, wherein the strap has a front edge and a rear edge, the strap further comprising an extended portion extending from the front edge of the strap to a forward end, the forward end of the extended portion defining the toe post engaging portion.

27. The shoe according to claim 21, wherein the strap is a first strap, the shoe further comprising a second strap selectively replacing the first strap.

28. The shoe according to claim 21, wherein the strap engaging feature of the toe post element is a snap element, the strap having a corresponding snap element such that the snap elements cooperate to interconnect the strap and the toe post element.

29. The shoe according to claim 21, wherein the sole member comprises a plurality of layers including an outsole layer defining the lower surface, a footbed layer defining the upper surface, and at least one midsole layer disposed between the outsole and footbed layers, the plurality of layers being joined together to form the sole member.

30. The shoe according to claim 29, wherein the strap engaging feature of the sole member is a slot extending through the sole member from the first side wall to the second side wall, one of the at least one midsole layers having a recess defined therein, the recess defining the slot through the sole member when the plurality of layers are joined together.

* * * * *

UNITED STATES PATENT AND TRADEMARK OFFICE

CERTIFICATE OF CORRECTION

PATENT NO. : 8,322,054 B2
APPLICATION NO. : 12/498452
DATED : December 4, 2012
INVENTOR(S) : Craig Feller et al.

It is certified that error appears in the above-identified patent and that said Letters Patent is hereby corrected as shown below:

Title Page, item (60), should read;

Related U.S. Application Data

This application claims benefit of 29/330,488 01/08/2009 PAT D600432
and claims benefit of 29/330,493 01/08/2009 PAT D602234
and claims benefit of 29/330,495 01/08/2009 PAT D615737
and claims benefit of 61/078,647 07/07/2008

Signed and Sealed this
Nineteenth Day of March, 2013

Teresa Stanek Rea
*Acting Director of the United States Patent and Trademark Office*